United States Patent [19]

Speil et al.

[11] Patent Number: 4,856,468

[45] Date of Patent: Aug. 15, 1989

[54] BALL-AND-SOCKET JOINT

[75] Inventors: Walter Speil, Ingolstadt; Dieter Schmidt, Nuremberg; Michael Zipprath, Herzogenaurach, all of Fed. Rep. of Germany

[73] Assignee: INA Walzlager Schaeffler KG, Fed. Rep. of Germany

[21] Appl. No.: 198,062

[22] Filed: May 24, 1988

[30] Foreign Application Priority Data

Jul. 30, 1987 [DE] Fed. Rep. of Germany ..... 3725245

[51] Int. Cl.[4] ..... F01L 1/18; F01L 1/24

[52] U.S. Cl. ..... 123/90.47; 123/90.46; 123/90.49

[58] Field of Search ..... 123/90.45, 90.46, 90.47, 123/90.48, 90.49, 90.52

[56] References Cited

U.S. PATENT DOCUMENTS

| | | | |
|---|---|---|---|
| 2,030,345 | 2/1936 | Zahodiakin | 123/90.47 |
| 3,805,753 | 4/1974 | Bergmann et al. | 123/90.46 |
| 3,880,128 | 4/1975 | Stirrat | 123/90.52 |
| 4,369,740 | 1/1983 | Seidl | 123/90.45 |
| 4,539,952 | 9/1985 | Nouno et al. | 123/90.45 |
| 4,762,099 | 8/1988 | Fujii et al. | 123/90.45 |

*Primary Examiner*—Willis R. Wolfe
*Assistant Examiner*—M. Macy
*Attorney, Agent, or Firm*—Bierman and Muserlian

[57] ABSTRACT

A ball-and-socket joint interposed between a rocker arm and a valve shaft of an internal combustion engine including a journal cooperating with the rocker arm and having a crowned end face which cooperates with a spherical cavity of a joint socket provided at its side opposing the spherical cavity with a plane surface by which it bears against the valve shaft wherein a restraining element is linked to the journal or to a structural element connected to the journal for grasping from behind the circumferential surface of the joint socket thereby securely holding the latter at the journal, characterized in that the restraining element is a spring element (10,19) which bears by elastic prestress against the joint socket (7) thereby holding the crowned end face (5) of the journal (4) in play free contact with the spherical cavity (6).

8 Claims, 6 Drawing Sheets

BALL-AND-SOCKET JOINT

STATE OF THE ART

Ball-and-socket joints interposed between a rocker arm and a valve shaft of an internal combustion engine and including a journal cooperating with the rocket arm and having a crowned end face which cooperates with a spherical cavity of a joint socket which is provided at its side opposing the spherical cavity with a plane surface by which it bears against the valve shaft wherein a restraining element is linked to the journal or to a structural element connected to the journal for grasping from behind the circumferential surface of the joint socket thereby securely holding the latter at the journal are known wherein the joint socket is grasped from behind by a restraining element so as to be securely held at the journal. This design allows a play between the crowned end face of the journal, on the one hand, and the spherical cavity of the joint socket, on the other hand. This, however, results at the point of contact in additional wear which should be avoided.

OBJECTS OF THE INVENTION

It is an object of the invention to avoid undesired play in a ball-and-socket by simple structural means to avoid the wear.

This and other objects and advantages of the invention will become obvious from the following detailed description.

THE INVENTION

The novel ball-and-socket joint of the invention interposed between a rocker arm and a valve shaft of an internal combustion engine including a journal cooperating with the rocker arm and having a crowned end face which cooperates with a spherical cavity of a joint socket provided at its side opposing the spherical cavity with a plane surface by which it bears against the valve shaft wherein a restraining element is linked to the journal or to a structural element connected to the journal for grasping from behind the circumferential surface of the joint socket thereby securely holding the latter at the journal, is characterized in that the restraining element is a spring element (10,19) which bears by elastic prestress against the joint socket (7) thereby holding the crowned end face (5) of the journal (4) in play free contact with the spherical cavity (6).

Referring now to the drawings.

Figure 1:
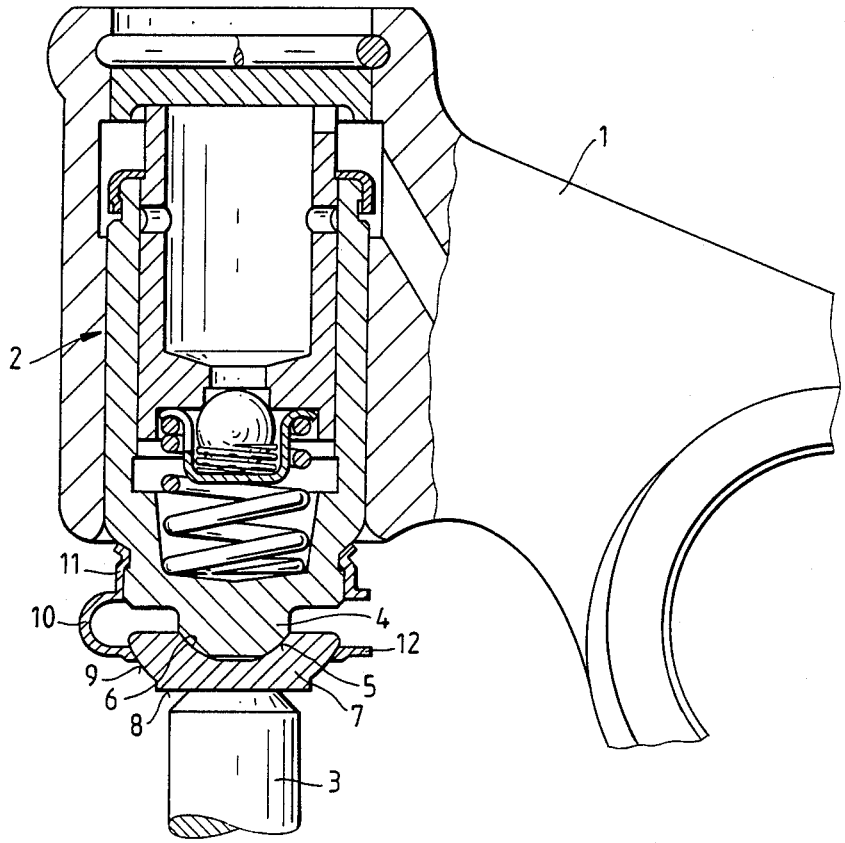
FIGS. 1,2,3,5,7,9 and 10 are longitudinal cross-sections of various embodiments of the ball-and-socket joints of the invention.

The embodiment illustrated in FIG. 1 includes a rocker arm 1 accommodating a known hydraulic play compensating element 2 which has a journal 4 with a crowned end face 5 at its end facing the valve shaft 3. The crowned end face 5 engages in the spherical cavity 6 of a joint socket 7 which includes at its opposing end a plane surface 8 by which it contacts the end face of the valve shaft 3.

The circumferential surface 9 of the joint socket 7 is crowned and the joint socket 7 is play-free supported at the crowned end face 5 of the journal 4 by a leaf spring 10 which, on the one hand, bears with a cylindrical collar 11 on the end of the piston of the hydraulic play compensating element 2 and is attached through rolling in a circumferential groove thereof, and, on the other hand, includes a U-shaped leg 12 with a circular bore by the edge of which the leg 12 bears against the crowned circumferential surface 9 and thus ensures a play-free contact between the spherical cavity 6 and the crowned end face 5. For providing a contact surface, the edge of the circular bore is designed slightly in form of a spherical cavity with a surface corresponding to the circumferential surface 9 of the joint socket 7.

Figure 2:
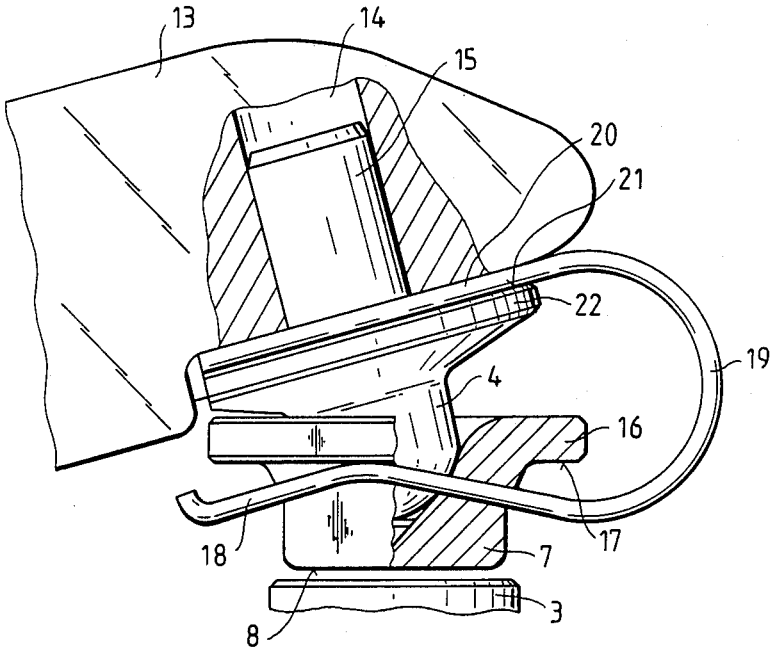

FIG. 2 illustrates an embodiment which is usable in engines with manual play adjustment and the rocker arm 13 includes a bore 14 in which an extension 15 of the journal 4 is inserted. As in the previously described example, the journal 4 contacts the joint socket 7 which in this case, however, does not have a crowned circumferential surface but rather includes at its end adjacent to the spherical cavity of the journal 4 a radial flange 16 with a radial surface 17 which faces away from the journal 4 and is abutted by the first leg 18 of the leaf spring 19. The second leg 20 of the leaf spring 19 is embedded between a plane surface of the rocker arm 13 and a radial surface 21 of a radial flange 22 which is arranged at the journal 4 at a distance from its crowned end face.

As can be seen from FIG. 2, the leg 18 of the leaf spring 19 in this embodiment engages off-center in the radial surface 17 of the radial flange 16 so that the joint socket 7 is turned relative to the longitudinal axis of the journal 4 by such an angle that its plane surface 8 extends parallel to the end face of the valve shaft 3. Thus, no additional wear-promoting tilting movement of the joint socket is required when placing the joint socket 7 on the valve shaft 3.

Figure 3:
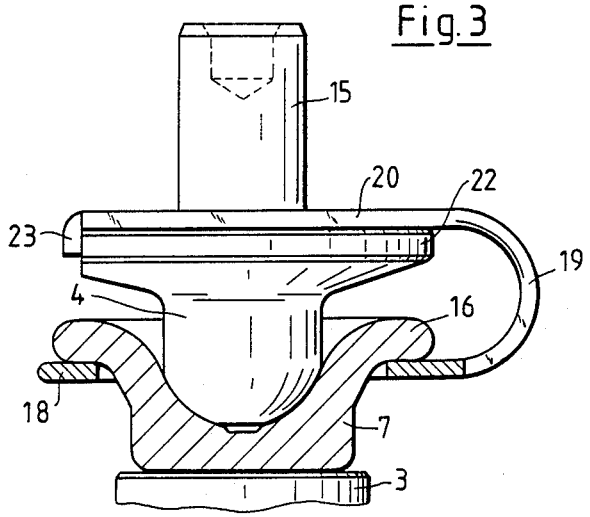
Figure 4:
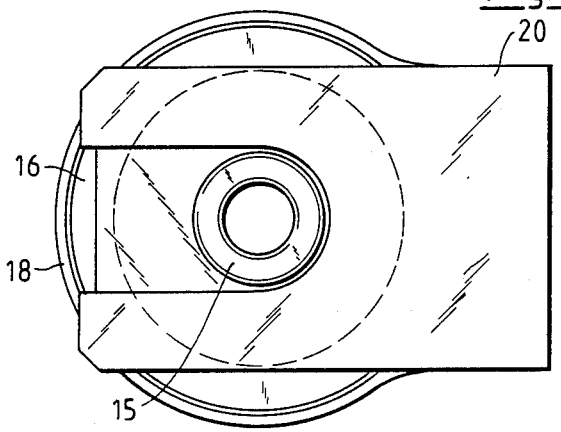
FIGS. 4,6 and 8 are top views of the embodiments of FIGS. 3,5 and 7, respectively.

The modification of FIGS. 3 and 4 corresponds essentially to the embodiment of FIG. 2. As can be seen from FIGS. 3 and 4, the second leg 20 of the leaf spring 19 embraces in a fork-like manner the extension 15 of the journal 4, and the ends 23 of the fork arms are angled so that they grasp the radial flange 22 from behind thereby preventing a slipping of the leaf spring.

Figure 5:
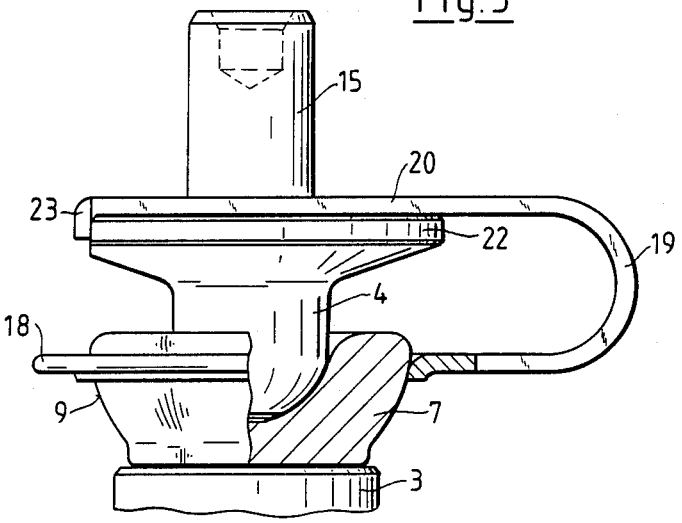
Figure 6:
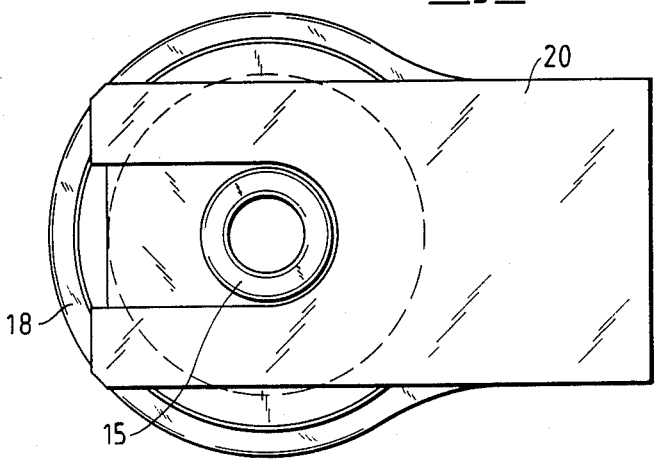
Figure 7:
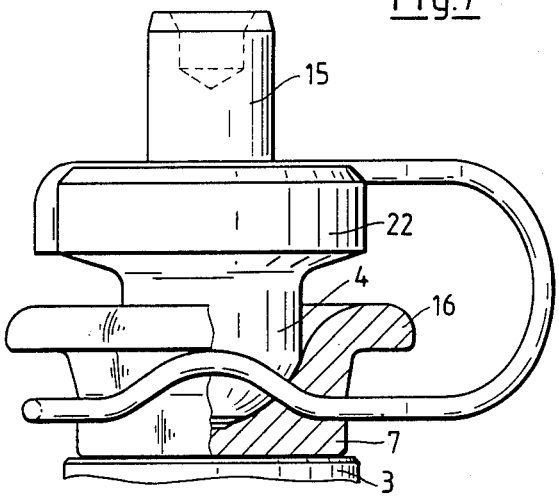
Figure 8:
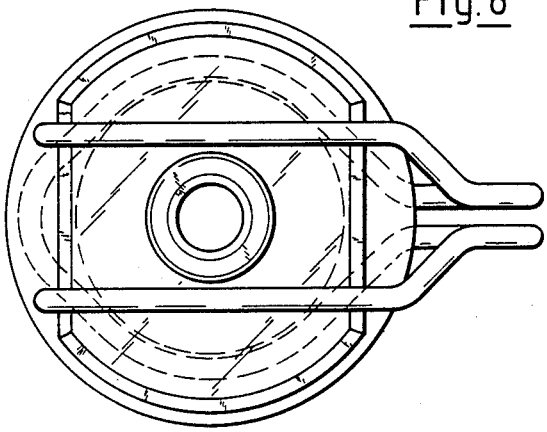

The modification of FIGS. 5 and 6 corresponds in its overall structure essentially to the embodiment of FIG. 1 while the attachment of the leaf spring corresponds essentially to FIGS. 3 and 4. While in the previously described embodiment, the spring element is designed in each case as a leaf spring, FIGS. 7 and 8 show constructions in which the spring element is made of round wire. Otherwise, this construction corresponds to the basic structure of the previously described embodiments.

Figure 9:
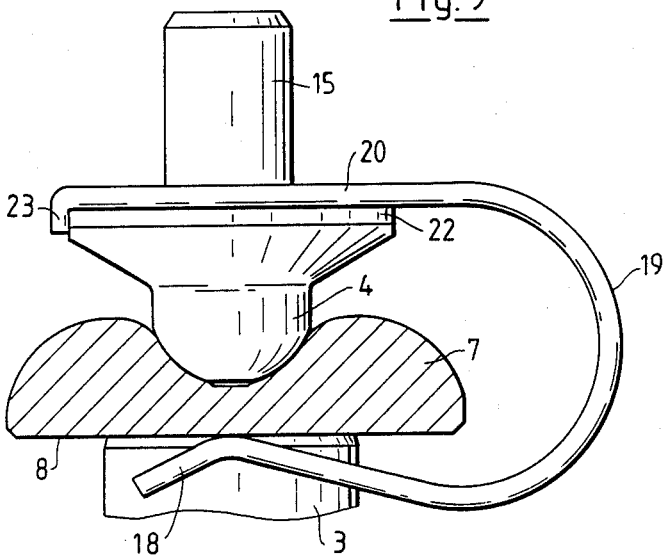
Figure 10:
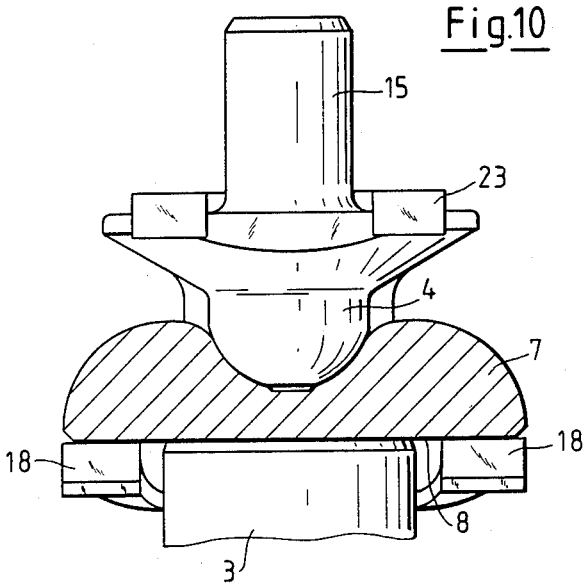

FIGS. 9 and 10 illustrate a further modification which differs from the previous ones in that the plane surface 8 of the joint socket 7 by which the latter bears against the valve shaft 3 has a greater diameter than the valve shaft 3. Both legs 18 of the leaf spring 19 which is bifurcated at its one end bears at both sides of the valve shaft 3 against the plane surface 8 at its area exceeding the valve shaft 3 to maintain contact of the joint socket 7 with the crowned end face of the journal 4.

Various other modifications of the joints of the invention may be made without departing from the spirit or scope thereof and it should be understood that the invention is intended to be limited only as defined in the appended claims.

What we claim is:

1. A ball-and-socket joint interposed between a rocker arm and a valve shaft of an internal combustion engine including a journal cooperating with the rocker arm and having a crowned end face which cooperates with a spherical cavity of a joint socket provided at its side opposing the spherical cavity with a plane surface by which it bears against the valve shaft wherein a restraining element is linked to the journal or to a structural element connected to the journal for grasping from behind the circumferential surface of the joint socket thereby securely holding the latter at the journal, characterized in that the restraining element is a spring element (10,19) which bears by elastic prestress against the joint socket (7) thereby holding the crowned end face (5) of the journal (4) in play free contact with the spherical cavity (6).

2. A ball-and-socket joint of claim 1, characterized in that the circumferential surace (9) of the joint socket (7) is crowned so as to have a greater outer diameter at its end adjacent to the spherical cavity (6) than at the end adjacent to the plane surface (8), and the spring element (10,19) has a circular bore by the edge of which it bears against the crowned circumferential surface (9).

3. A ball-and-socket joint of claim 2 characterized in that the edge of the circular bore is slightly in the form of a spherical cavity for providing a contact surface.

4. A ball-and-socket joint of claim 1 characterized in that the joint socket (7) has at its end adjacent to the spherical cavity (6) a radial flange (16) with a radial surface (17) which faces way from the journal (4) and is abutted by the leaf spring (19).

5. A ball-and-socket joint of claim 1 characterized in that the plane surface (8) of the joint socket (7) by which the latter bears against the valve shaft (3) has a greater diameter than the valve shaft (3), and the bifurcated leg (18) of the leaf spring (19) bears against the plane surface (8) at its area radially exceeding the valve shaft (3).

6. A ball-and-socket joint of claim 1 characterized in that the spring element (10,19) is essentially a U-shaped bracket with a first leg (18) pressing against the joint socket (7) and a second leg (20) attached to the journal (4).

7. A ball-and-socket joint of claim 6 characterized in that the journal (4) has at a distance from the crowned end face (5) a radial flange (22) with a radial surface (21) which faces away from the crowned end face (5) and is abutted by the second leg (20) of the bracket.

8. A ball-and-socket joint of claim 1 characterized in that the spring element (19) is shaped in such a way and/or bears on such an area of the joint socket (7) that the latter is turned by an angle relative to the longitudinal axis of the journal (4) so that its plane surface (8) extends parallel to the end face of the valve shaft (3).

* * * * *